US007172079B1

(12) United States Patent
Shiao

(10) Patent No.: US 7,172,079 B1
(45) Date of Patent: Feb. 6, 2007

(54) MAGNET RACK THAT CAN BE EASILY REMOVED FROM A MAGNETICALLY ATTRACTIVE SURFACE

(76) Inventor: Hsuan-Sen Shiao, No. 55, Cheng-Feng Lane, Tia-Ming Rd, Wu-Jih Hsiang, Taichung-Hsien (TW)

( * ) Notice: Subject to any disclaimer, the term of this patent is extended or adjusted under 35 U.S.C. 154(b) by 0 days.

(21) Appl. No.: 11/270,658

(22) Filed: Nov. 10, 2005

(51) Int. Cl.
*A47F 7/00* (2006.01)

(52) U.S. Cl. ..... 211/70.6; 206/350; 206/379; 206/818

(58) Field of Classification Search ..... 211/70.6, 211/70.7; 248/37.3; 206/350, 379, 378, 206/818, 477, 483, 565; 220/916
See application file for complete search history.

(56) References Cited

U.S. PATENT DOCUMENTS 2,565,624 A * 8/1951 Phelon ..... 335/285
2,697,804 A * 12/1954 Phelon ..... 335/285
2,966,992 A * 1/1961 Dunkelberger et al. .... 211/70.7
3,842,980 A * 10/1974 Kushner ..... 248/205.3
4,451,810 A * 5/1984 Miller ..... 335/285
4,544,067 A * 10/1985 Miller ..... 211/70.6
4,785,936 A * 11/1988 Shpigelman ..... 206/454
6,006,906 A * 12/1999 Winnard ..... 206/350
6,179,155 B1 * 1/2001 Komiya et al. ..... 220/592.11

* cited by examiner

*Primary Examiner*—Richard E. Chilcot, Jr.
*Assistant Examiner*—Lindsay M. Maguire
(74) *Attorney, Agent, or Firm*—Hunton & Williams

(57) ABSTRACT

A magnetic rack includes a hollow rack body confining a magnet compartment, a magnet unit received in the magnet compartment, and a release component mounted pivotally on an end portion of the rack body. The release component is pivotable relative to the end portion of the rack body between first and second positions, permits the end portion of the rack body to abut firmly against a magnetically attractive surface by virtue of magnetic attraction between the magnet unit and the magnetically attractive surface when the release component is at the first position, and is adapted to push against the magnetically attractive surface to move the end portion of the rack body away from the magnetically attractive surface and facilitate moving of the rack body to another location on the magnetically attractive surface when the release component is at the second position.

8 Claims, 7 Drawing Sheets

MAGNET RACK THAT CAN BE EASILY REMOVED FROM A MAGNETICALLY ATTRACTIVE SURFACE

BACKGROUND OF THE INVENTION

1. Field of the Invention

The invention relates to a magnetic rack, more particularly to a magnetic rack that can be easily removed from a magnetically attractive surface.

2. Description of the Related Art

FIG. 1 illustrates a conventional magnetic rack that can be attached to a metal surface 4. The magnetic rack includes a hollow rack body 1 and a plurality of permanent magnets 2 disposed in the rack body 1. By virtue of the magnetic forces of the permanent magnets 2, the rack body 1 can be attached to an arbitrary location on the metal surface 4. In addition, hand tools 3 can be retained on the rack body 1 by magnetic attraction.

In the conventional magnetic rack, the magnetic forces of the permanent magnets 2 cause an inner wall part of the rack body 1 to abut firmly and completely against the metal surface 4. As a result, it is difficult to move the conventional magnetic rack to another location on the metal surface 4. In addition, the magnetic rack is not provided with a handgrip part that enables the user to conveniently exert a pulling force for pulling the magnetic rack away from the metal surface 4, which necessitates the use of an additional tool for removing the magnetic rack from the metal surface 4.

SUMMARY OF THE INVENTION

Therefore, the object of the present invention is to provide a magnetic rack that can be easily removed from a magnetically attractive surface without using an additional tool.

According to this invention, a magnetic rack comprises a hollow rack body confining a magnet compartment, a magnet unit received in the magnet compartment, and a release component mounted pivotally on an end portion of the rack body. The release component is pivotable relative to the end portion of the rack body between first and second positions, permits the end portion of the rack body to abut firmly against a magnetically attractive surface by virtue of magnetic attraction between the magnet unit and the magnetically attractive surface when the release component is at the first position, and is adapted to push against the magnetically attractive surface to move the end portion of the rack body away from the magnetically attractive surface and facilitate moving of the rack body to another location on the magnetically attractive surface when the release component is at the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
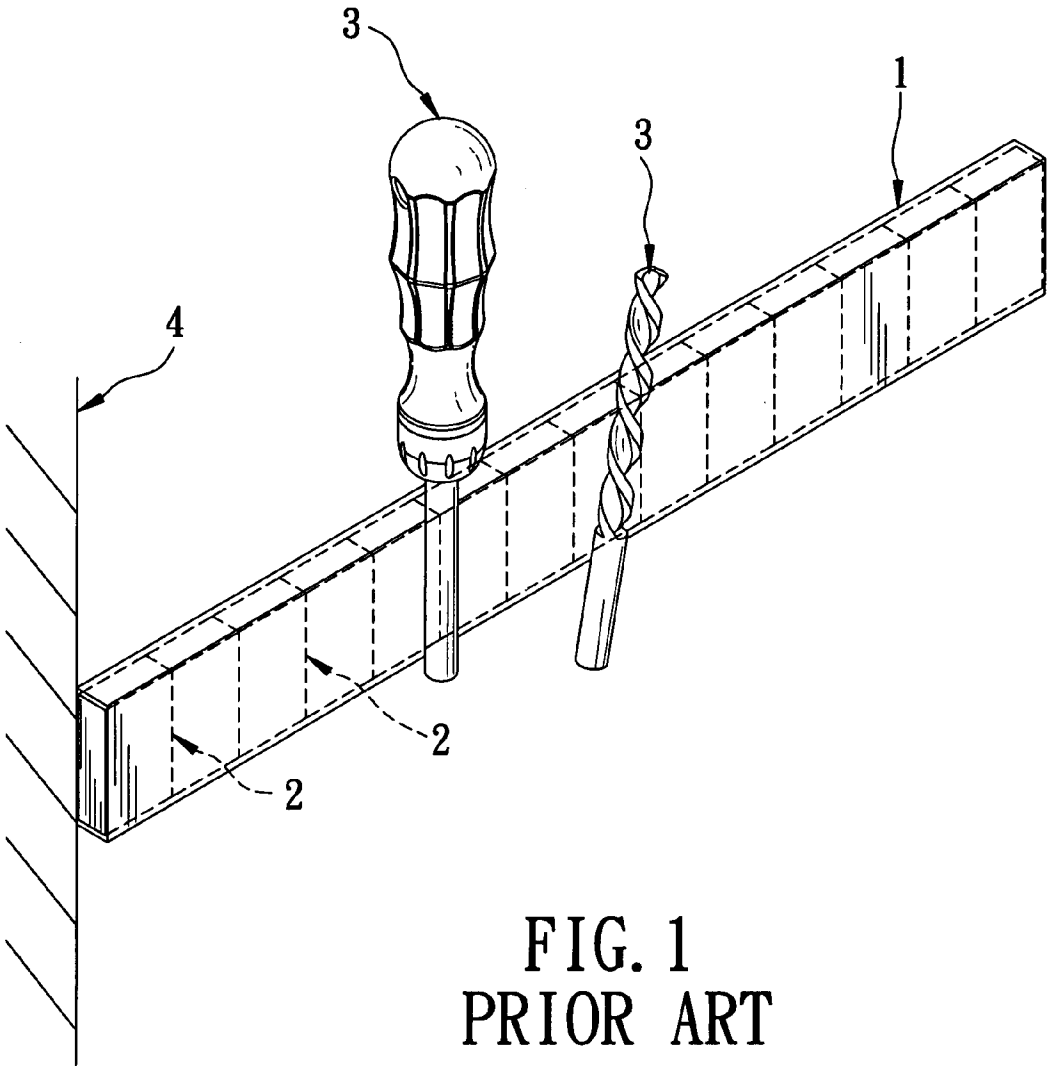
FIG. 1 PRIOR ART
FIG. 1 is a perspective view illustrating a conventional magnetic rack in a state of use.
Figure 2:
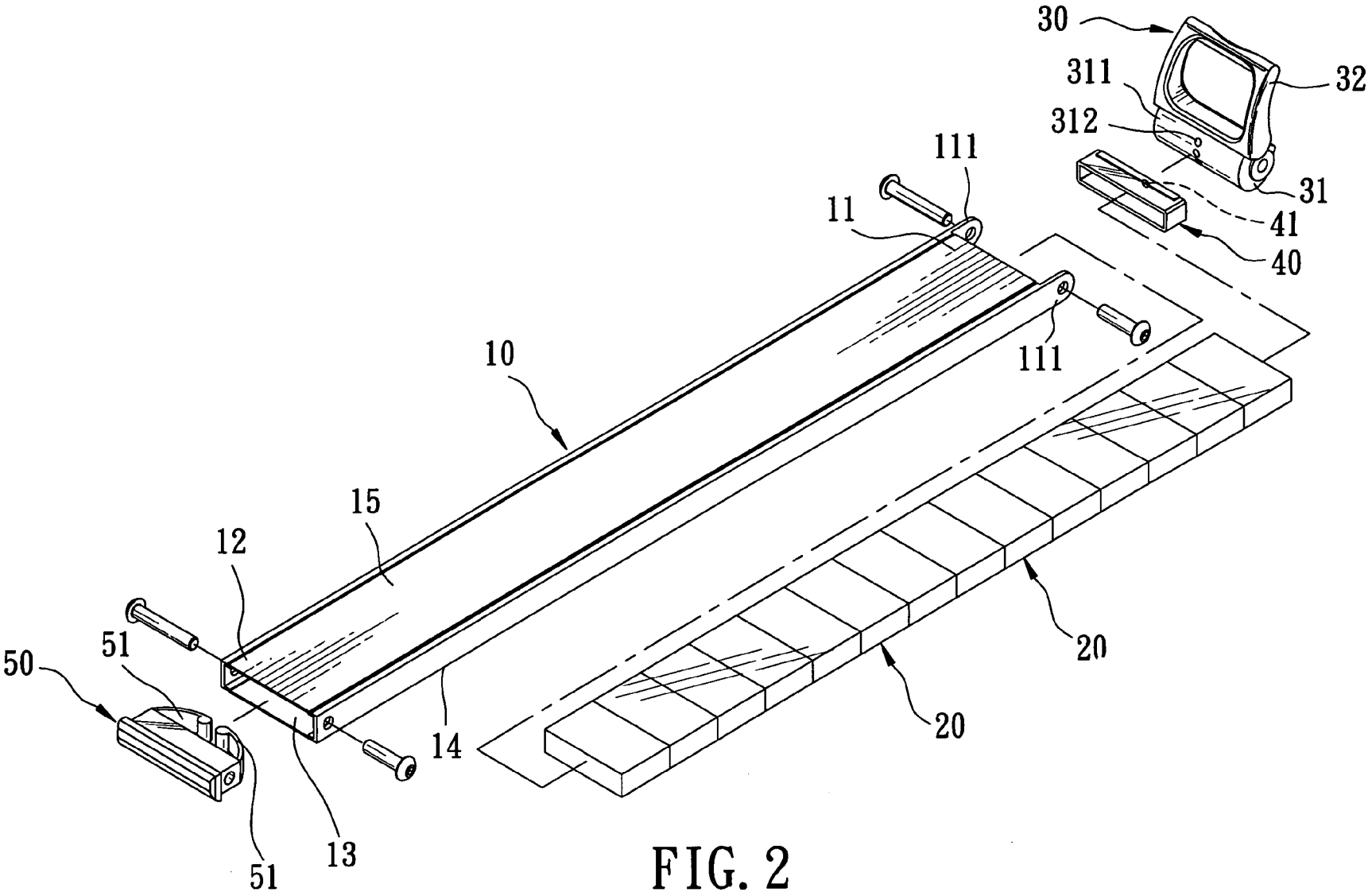
FIG. 2 is an exploded perspective view of the preferred embodiment of a magnetic rack according to the present invention.
Figure 3:
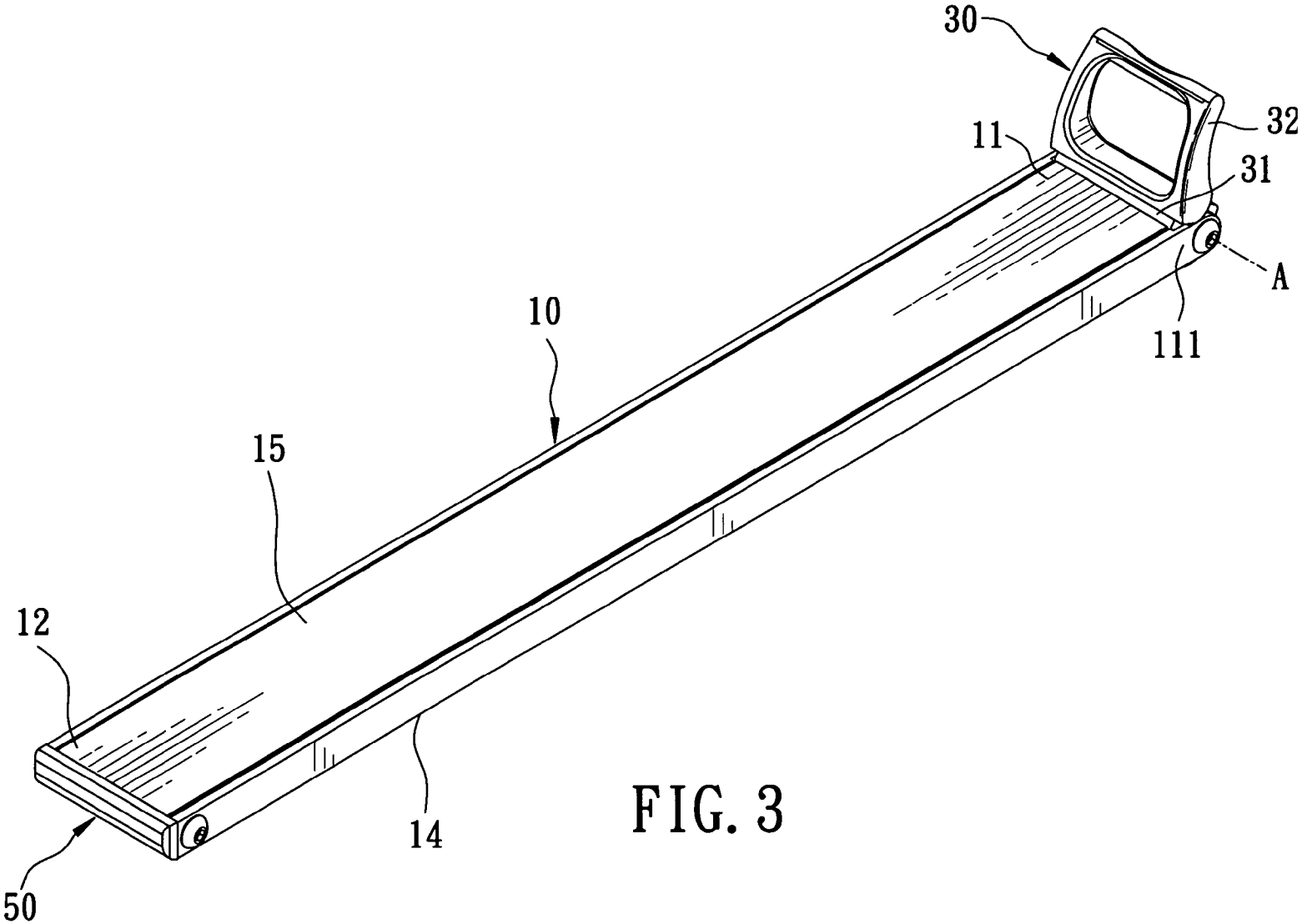
FIG. 3 is an assembled perspective view of the preferred embodiment.
Figure 4:
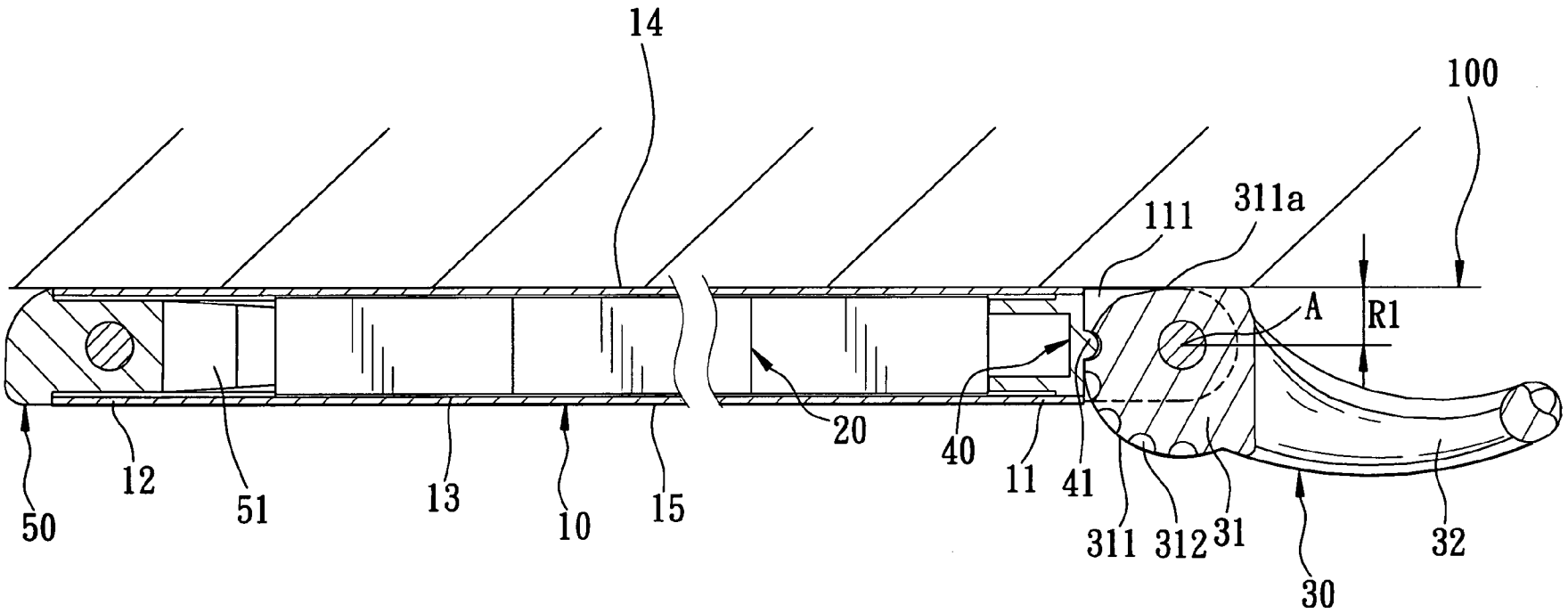
FIG. 4 is a partly sectional view of the preferred embodiment, illustrating a release component thereof when at a first position.

Referring to FIGS. 2, 3 and 4, the preferred embodiment of a magnetic rack according to the present invention is adapted for attachment to a magnetically attractive surface 100, and is shown to include an elongated hollow rack body 10, a magnet unit including a set of permanent magnets 20, a release component 30, a first end cap 40, and a second end cap 50.

The rack body 10 has a first end portion 11, a second end portion 12 opposite to the first end portion 11 in a longitudinal direction of the rack body 10, and a magnet compartment 13 that extends in the longitudinal direction from the first end portion 11 to the second end portion 12 and that receives the permanent magnets 20 therein. The rack body 10 includes an inner wall part 14 that extends in the longitudinal direction, and an outer wall part 15 that extends in the longitudinal direction and that is opposite to the inner wall part 14 in a transverse direction transverse to the longitudinal direction. The rack body 10 is formed with a pair of pivot lugs 111 at the first end portion 11.

Figure 5:
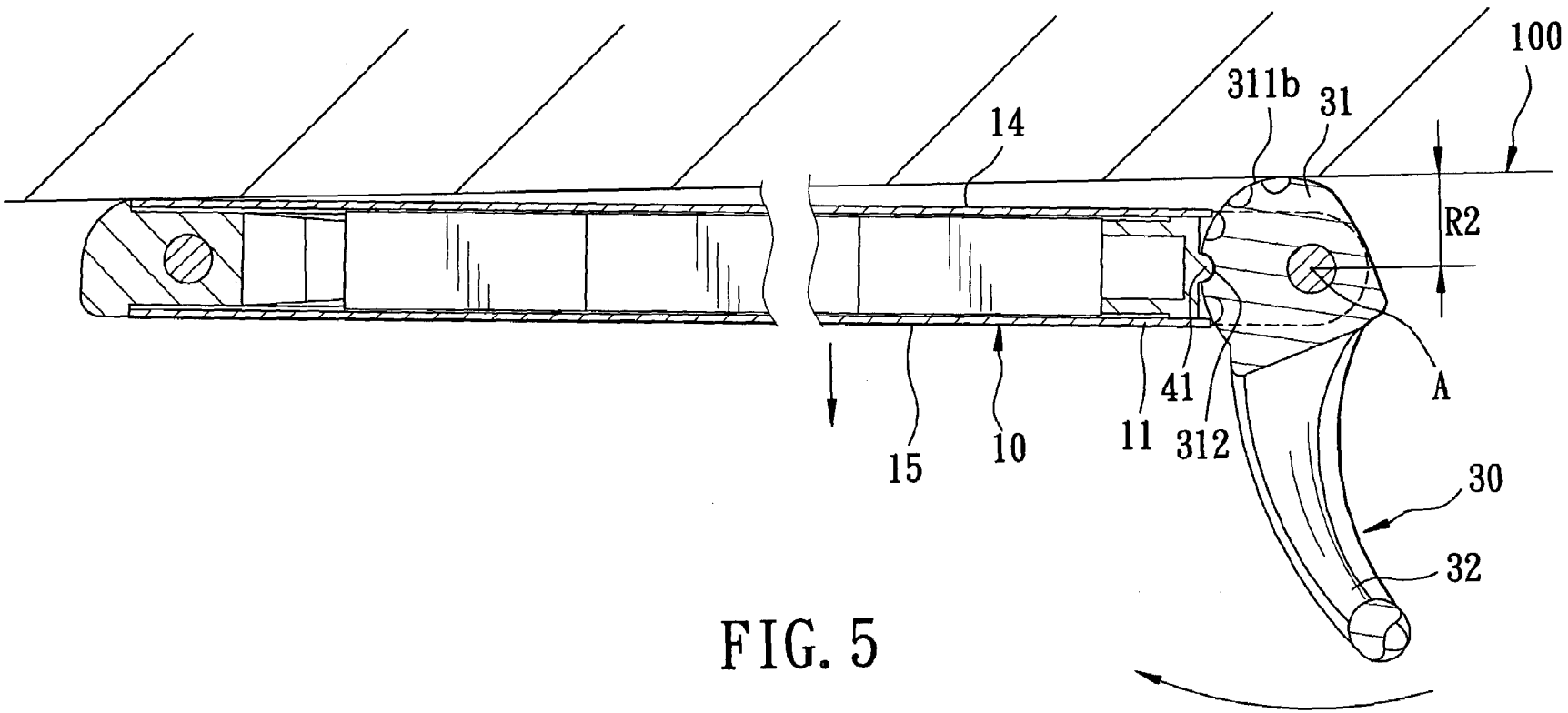
FIG. 5 is a view similar to FIG. 4, but illustrating the release component when at a second position.
Figure 6:
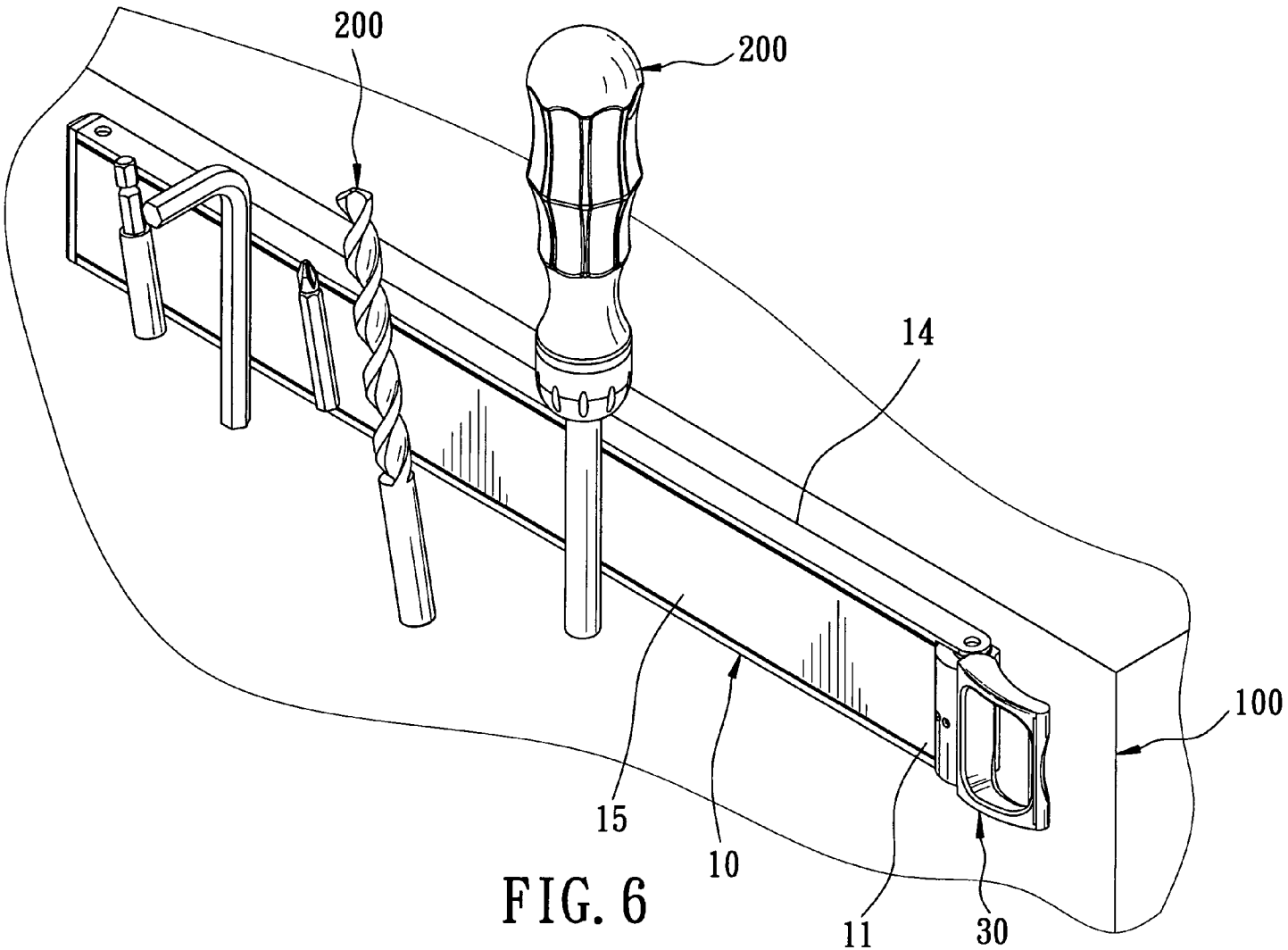
FIG. 6 is a perspective view illustrating the preferred embodiment in a state of use, with the release component at the first position.
Figure 7:
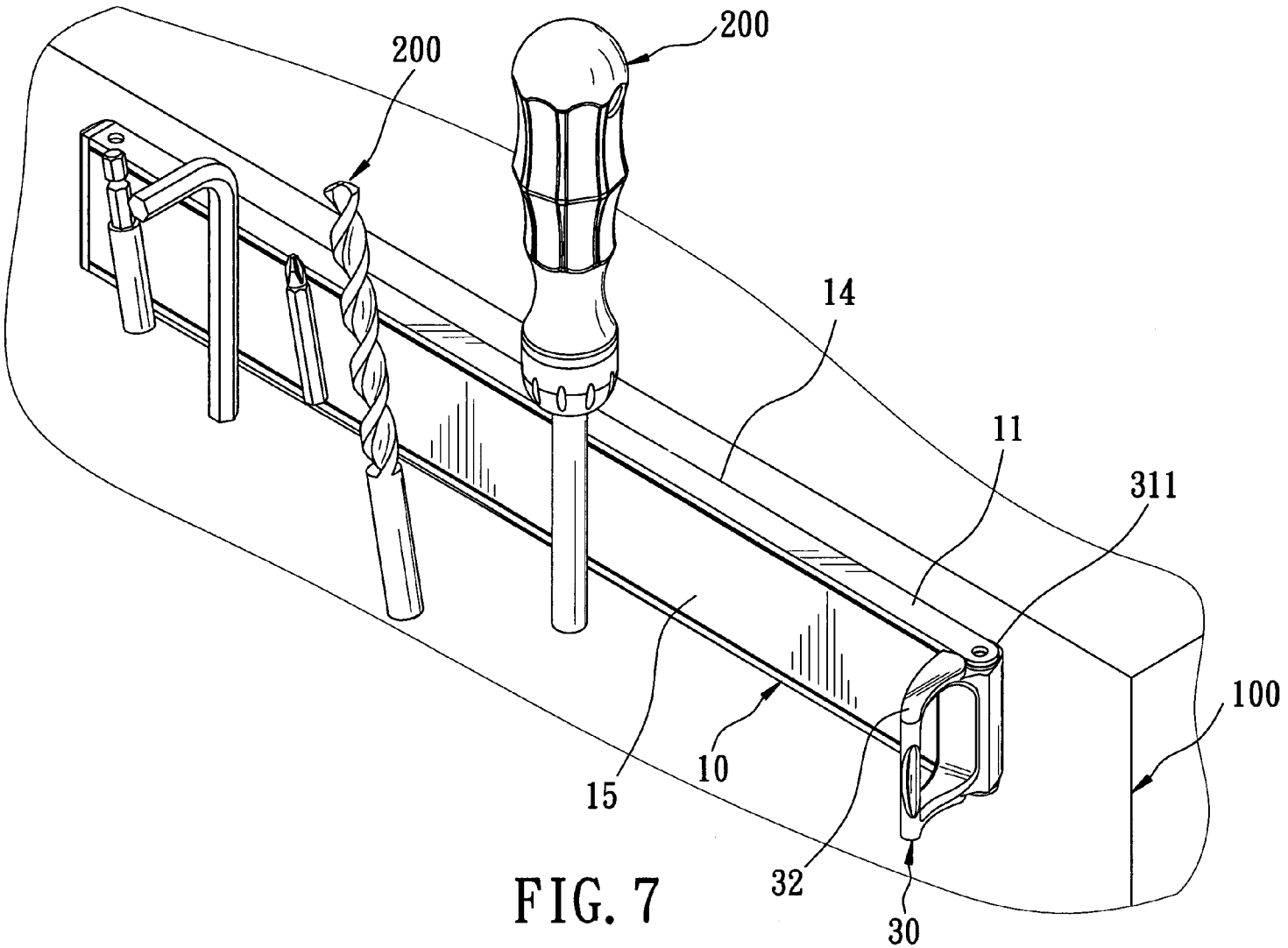
FIG. 7 is a view similar to FIG. 6, but with the release component at the second position.

The release component 30 is mounted pivotally on the first end portion 11 of the rack body 10, and is pivotable relative to the first end portion 11 between a first position (see FIGS. 4 and 6) and a second position (see FIGS. 5 and 7). In this embodiment, the release component 30 includes a cam portion 31 that is pivoted between the pivot lugs 111 and that is pivotable about a pivot axis (A) transverse to the longitudinal and transverse directions, and a handgrip portion 32 that extends from the cam portion 31 and that is adapted for gripping by the user. The cam portion 31 has a cam surface 311 disposed to abut against the magnetically attractive surface 100. In this embodiment, the cam surface 311 has a first cam segment (311*a*) (see FIG. 4) and a second cam segment (311*b*) (see FIG. 5) opposite to the first cam segment (311*a*) in a pivoting direction of the release component 30. The first cam segment (311*a*) forms a first distance (R1) (see FIG. 4) with the pivot axis (A), and is disposed to abut against the magnetically attractive surface 100 when the release component 30 is at the first position. The second cam segment (311*b*) forms a second distance (R2) (see FIG. 5) with the pivot axis (A) that is larger than the first distance (R1), and is disposed to abut against the magnetically attractive surface 100 when the release component 30 is at the second position. In this embodiment, the cam surface 311 is a curved surface, and the distance of the cam surface 311 from the pivot axis (A) is gradually increased from the first cam segment (311*a*) to the second cam segment (311*b*).

The first end cap 40 is mounted in the first end portion 11 of the rack body 10, and is formed with a locating stub 41 that projects toward the cam portion 31 of the release component 30. The cam surface 311 is formed with a series of locating recesses 312 spaced apart from each other in the pivoting direction of the release component 30. The locating stub 41 engages removably an aligned one of the locating recesses 312 during movement of the release component 30 between the first and second positions. As a result, stepwise transition of the release component 30 between the first and second positions is possible when the user operates the handgrip portion 32 of the release component 30.

The second end cap 50 is mounted in the second end portion 12 of the rack body 10, and is provided with a pair of spring strips 51 for biasing the permanent magnets 20 in the magnet compartment 13 toward the first end cap 40.

Therefore, as best shown in FIGS. 4 and 6, when the release component 30 is at the first position, the first cam segment (311*a*) of the cam surface 311 of the cam portion 31 of the release component 30 permits the inner wall part 14 to abut firmly against the magnetically attractive surface 100 at the first end portion 11 of the rack body 10 by virtue of magnetic attraction between the permanent magnets 20 and the magnetically attractive surface 100. The magnetic rack is attached firmly to the magnetically attractive surface 100, and hand tools 200 can be retained on the outer wall part 15 of the rack body 10 by magnetic attraction at this time.

On the other hand, as best shown in FIGS. 5 and 7, when the user operates the handgrip portion 32 to pivot the release component 30 relative to the first end portion 11 of the rack body 10 from the first position to the second position, the second cam segment (311*b*) of the cam surface 311 of the cam portion 31 of the release component 30 pushes against the magnetically attractive surface 100 to move the first end portion 11 of the rack body 10 away from the magnetically attractive surface 100. In view of the diminished magnetic attraction between the permanent magnets 20 and the magnetically attractive surface 100, moving of the rack body 10 to another location on the magnetically attractive surface 100 is facilitated accordingly when the release component 30 is at the second position.

While the magnetic rack of this embodiment includes the release component 30 provided only on the first end portion 11 of the rack body 10, it should be apparent to those skilled in the art that another similar release component (not shown) may be mounted pivotally on the second end portion 12 of the rack body 10 in other embodiments of this invention, such that the magnetic rack can be detached from the magnetically attractive surface 100 using both hands of the user.

It has thus been shown that by virtue of the release component 30, removal of the magnetic rack of this invention from the magnetically attractive surface 100 can be conducted with relative ease through user operation of the handgrip portion 32 of the release component 30 and without using an additional tool.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A magnetic rack adapted for attachment to a magnetically attractive surface, said magnetic rack comprising:

a hollow rack body that confines a magnet compartment and that has a first end portion;

a magnet unit received in said magnet compartment; and a release component mounted pivotally on said first end portion of said rack body, said release component being pivotable relative to said first end portion of said rack body between first and second positions, said release component permitting said first end portion of said rack body to abut firmly against the magnetically attractive surface by virtue of magnetic attraction between said magnet unit and the magnetically attractive surface when said release component is at the first position, and being adapted to push against the magnetically attractive surface to move said first end portion of said rack body away from the magnetically attractive surface and facilitate moving of said rack body to another location on the magnetically attractive surface when said release component is at the second position.

2. The magnetic rack as claimed in claim 1, wherein said rack body further has a second end portion opposite to said first end portion, said magnet compartment extending from said first end portion to said second end portion, said first end portion of said rack body being formed with a pair of pivot lugs for mounting pivotally said release component on said first end portion of said rack body.

3. The magnetic rack as claimed in claim 2, wherein said release component includes a cam portion that is pivoted between said pivot lugs about a pivot axis, and a handgrip portion that extends from said cam portion, said cam portion having a cam surface disposed to abut against the magnetically attractive surface, said cam surface having a first cam segment and a second cam segment opposite to said first cam segment in a pivoting direction of said release component, said first cam segment forming a first distance with the pivot axis and being disposed to abut against the magnetically attractive surface when said release component is at the first position, said second cam segment forming a second distance with the pivot axis that is larger than the first distance, and being disposed to abut against the magnetically attractive surface when said release component is at the second position.

4. The magnetic rack as claimed in claim 3, wherein said cam surface is a curved surface, and the distance of said cam surface from the pivot axis is gradually increased from said first cam segment to said second cam segment.

5. The magnetic rack as claimed in claim 4, wherein said cam surface is formed with a series of locating recesses spaced apart from each other in the pivoting direction of said release component, said magnetic rack further comprising a first end cap mounted in said first end portion of said rack body, and formed with a locating stub that projects toward said cam portion of said release component to engage removably an aligned one of said locating recesses during movement of said release component between the first and second positions.

6. The magnetic rack as claimed in claim 5, further comprising a second end cap mounted in said second end portion of said rack body.

7. The magnetic rack as claimed in claim 6, wherein said second end cap is provided with a spring strip for biasing said magnet unit toward said first end cap.

8. The magnetic rack as claimed in claim 7, wherein said magnet unit includes a set of permanent magnets.

* * * * *